United States Patent [19]

Aoki

[11] 4,019,561

[45] Apr. 26, 1977

[54] INJECTION APPARATUS FOR DIE CAST MACHINES

[75] Inventor: Kazuteru Aoki, Zama, Japan

[73] Assignee: Toshiba Kikai Kabushiki Kaisha, Tokyo, Japan

[22] Filed: Feb. 7, 1975

[21] Appl. No.: 547,813

[30] Foreign Application Priority Data

Feb. 12, 1974 Japan ..... 49-16929

[52] U.S. Cl. ..... 164/155; 164/4; 164/314

[51] Int. Cl.[2] ..... B22D 17/32

[58] Field of Search ..... 164/151, 155, 315, 314, 164/306, 4

[56] References Cited

UNITED STATES PATENTS

| | | | |
|---|---|---|---|
| 3,601,180 | 8/1971 | Nef et al. | 164/315 |
| 3,731,727 | 5/1973 | Mitamura et al. | 164/315 X |

FOREIGN PATENTS OR APPLICATIONS

| | | | |
|---|---|---|---|
| 2,122,797 | 11/1972 | Germany | 164/315 |
| 1,284,574 | 12/1968 | Germany | 164/315 |

*Primary Examiner*—Ronald J. Shore
*Assistant Examiner*—Gus T. Hampilos
*Attorney, Agent, or Firm*—Spensley, Horn & Lubitz

[57] ABSTRACT

In injection apparatus of the type wherein molten metal is injected into the metal mold of a die casting machine by an injection plunger and the fluid pressure acting upon the injection pressure is increased by a booster piston at or near the end of the forward stroke of the injection piston by means of a booster cylinder, a limit switch is mounted along the path of the forward stroke of the injection piston to be operated thereby as so to operate the booster piston at any desired point of the forward stroke.

5 Claims, 4 Drawing Figures

INJECTION APPARATUS FOR DIE CAST MACHINES

BACKGROUND OF THE INVENTION

This invention relates to injection apparatus for die cast machines and more particularly to an improved fluid pressure control system for the injection apparatus.

To have better understanding of the invention a typical injection apparatus for a die cast machine will first be described with reference to FIG. 1 of the accompanying drawing, which diagrammatically illustrates a prior art fluid pressure control system for an injection cylinder of a die cast machine, not shown.

When a solenoid valve 3 is switched from position X to position Y, pressurized operating fluid, oil for example, from an accumulator ACC flows into the rear chamber 1 of a booster cylinder 8 through the restricted passage at position Y and a pipe 4. Then the operating fluid flows into the rear chamber 6 of an injection cylinder 7 via a check valve 13 in the booster cylinder 8 for advancing (toward left) the injection piston A at a low speed. Although not shown in the drawing, the righthand portion of the check valve 13 comprises a tube extending through booster piston B and containing a rod leading to a piston 16. The tube is provided with an opening for admitting the operating fluid into the interior of the booster piston B by opening the check valve 13. The operating fluid then enters into the rear chamber 6 through an opening, not shown, through the fore end wall of the booster piston B. When the injection piston A reaches a predetermined position while moving at the low speed, the solenoid valve 3 is switched from position Y to position Z so that the operating fluid from the accumulator ACC will enter into the rear chamber 6 of the injection cylinder 7 without passing through the restricted passage at position Y, thus advancing the injection piston at a high speed. During this high speed advancement of the injection piston A, the pressure of the operating fluid in the rear chamber 1 of the booster cylinder 8 and the rear chamber 6 of the injection cylinder 7 is relatively low due to the high speed movement of the injection piston A. For this reason, where the set pressure of a sequence valve 10 is selected to be higher than the pressure prevailing in said rear chambers at the time when the injection piston A is moving forwardly, the operating fluid in the fore chamber 2 of the booster cylinder 8 will be maintained at a sealed condition so that the booster piston B will not be advanced. As the injection piston A advances further so as to completely fill a metal mould, not shown, with molten metal or alloy, the load on the injection piston A increases, this condition being termed the "limit of pouring of the molten metal".

When the injection piston A reaches this limit while moving forwardly at high speed, the pressure of the operating fluid in the rear chamber 6 of the injection cylinder 7 rises, thereby closing the check valve 13. The pressure of the operating fluid in the rear chamber 1 of the booster cylinder 8 also rises to a predetermined pressure determined by the injection condition or the like. This increased pressure is transmitted to a sequence valve 10 through a pipe 4*c* thereby opening the sequence valve 10 and then opening a relief valve 9. As a consequence, the operating fluid in the fore chamber 2 of the booster cylinder 8 will be returned to a reservoir T via pipe 4*d*, valves 10 and 9, throttle valve 14, the fore chamber 15 of the injection cylinder 7 and a pipe 5. Accordingly, the booster piston B begins to move in the forward direction whereby the pressure of the operating fluid in the rear chamber 6 of the injection piston 7 is increased by the difference between the pressure receiving areas of front and rear surfaces of the booster piston B with the result that pressure is applied to the molten metal poured into the metal mould. A check valve 17 is provided for returning the booster piston to the original position.

FIG. 4 is an oscillogram showing the relationship between time (abscissa) and pressure (ordinate) prevailing while the injection cylinder of a die cast machine is operating. As shown, during the low speed stroke, the injection piston advances under a relatively low pressure whereas during the high speed stroke as the resistance against forward movement increases the pressure in the rear chamber 6 of the injection cylinder 7 increases somewhat above that of the low speed stroke. As the injection piston A reaches the limit of pouring of the molten metal it cannot advance further so that the pressure of the operating fluid in the rear chamber 6 of the injection cylinder 7 increases thus closing the check valve 13 in the booster piston B. The interval between the limit of pouring of the molten metal and the closure of the check valve 13 corresponds to an interval in which the pouring pressure increases.

When the check valve 13 in the booster piston B closes, the pressure of the operating fluid in the rear chamber 1 of the booster cylinder 8 increases so that the sequence valve 10 and the relief valve 9 are opened to discharge the operating fluid in the fore chamber 2 of the booster cylinder 8 into reservoir T through these valves. Accordingly, the booster piston B is permitted to advance thus compressing the operating fluid in the rear chamber 6 of the injection cylinder 7. The interval between this instant and the end of the pouring pressure increasing interval corresponds to the time lag of pressure increase. Thereafter, as the booster piston B advances, increased pressure of the operating fluid sealed in the rear chamber 6 of the injection cylinder 7 acts upon the injection piston A. The interval between the end of the time lag of pressure increase and an instant at which increase in the pressure acting upon the injection piston A ceases corresponds to the pressure increasing interval shown in the graph.

The sum of the pouring pressure increasing interval, the time lag of pressure increase and the pressure increasing interval is shown as a pressure build-up interval. The relationship between the pressure build-up and the time elapse during this interval has an important influence upon the quality of the die castings. More particularly, as the molten metal poured into the mould solidifies as the time elapses it is necessary to apply pressure to the mould as fast as possible. To this end, it is essential to greatly decrease the pressure build-up interval.

In the injection apparatus described above, when the injection piston A reaches the limit of pouring of the molten metal and cannot advance further, the pressure of the operating fluid in the rear chamber 6 of the injection cylinder 7 rises rapidly, thus closing the check valve 13 in the booster piston B. Then, the pressure in the rear chamber 1 of the booster cylinder 8 rises to open the sequence valve 10 and the relief valve 9 thus advancing the booster piston B by discharging the operation fluid in the fore chamber 2 of the booster cylinder 8 through valves 10 and 9 so that the time lag of pressure increase is considerably large.

Furthermore, for the purpose of increasing or decreasing the pressure increasing interval shown in FIG. 4 in accordance with the configuration, or thickness of the die castings, the rate of discharge of the operating fluid in the fore chamber 2 of the booster cylinder 8 into reservoir T is controlled by the throttle valve 14. However, with the apparatus described, to decrease further the pressure increasing interval it is necessary to decrease the flow resistance of various pipe lines as well as the resistance to the operating fluid in the fore chamberr 2 of the booster cylinder 8. In addition, as it is necessary to provide valves for passing a large quantity of the operating fluid, the cost of installation increases.

SUMMARY OF THE INVENTION

It is an object of this invention to provide improved injection apparatus for casting machines capable of starting the booster piston at any time during the forward stroke of the injection piston for increasing the fluid pressure acting thereon thus decreasing the time lag of pressure increase.

Another object of this invention is to provide an improved apparatus for casting machines which can adjust the forward speed of the booster piston to any desired value.

According to this invention, these and other objects can be accomplished by providing injection apparatus for a die cast machine of the type comprising an injection cylinder for injecting molten metal into the metal mould of the die cast machine; a booster cylinder including a small diameter portion connected to the injection cylinder, and a large diameter portion; a booster piston contained in the booster cylinder and having a small diameter portion operatively connected to the injection piston through operating fluid and a large diameter portion contained in the large diameter portion of the booster cylinder; a source of pressurized operating fluid; and valve means for applying the pressurized operating fluid to the injection piston and the booster piston, characterized in that there are provided means for controlling the valve means at a predetermined point in the forward stroke of the injection cylinder for increasing the quantity of the operating fluid flowing into the rear chamber of the booster cylinder thereby increasing the fluid pressure acting upon the injection cylinder.

The last mentioned means for controlling the valve means comprises a timer interlocked with the injection piston or a limit switch adjustably mounted on the path of movement of the injection piston to be operated thereby. Preferably, a plurality of limit switches are provided for starting the booster piston at a low speed and then driving the booster piston at a high speed for applying required high pressure upon the injection piston.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 2:
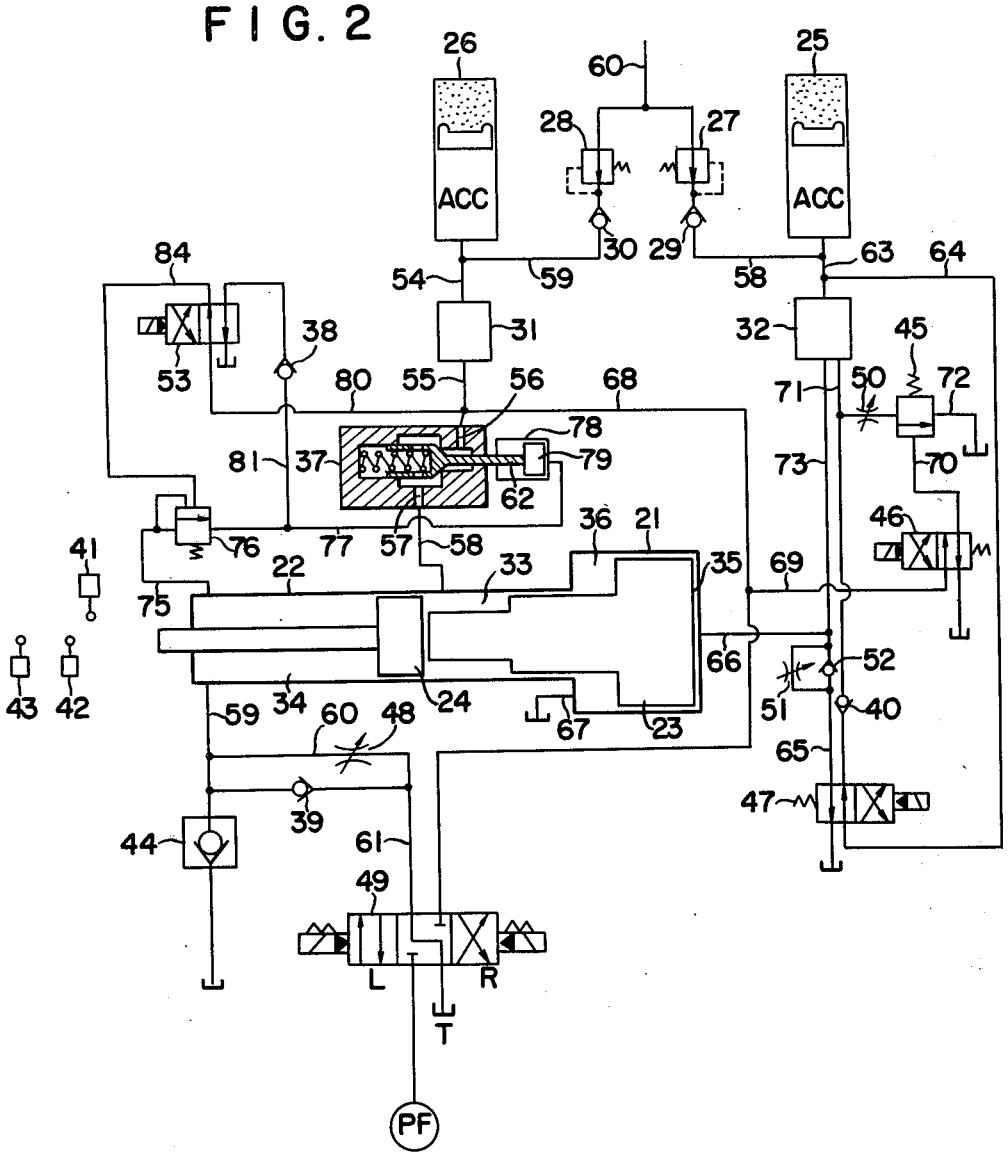
FIG. 2 is a connection diagram of the fluid pressure control system constructed in accordance with this invention.

Referring now to FIG. 2 which shows a state at which the injection operation of a die cast machine has just started, a stepped booster cylinder 21 is shown as being coaxially connected with an injection cylinder 22. The booster cylinder 21 contains a booster piston 23 including a large diameter portion contained in the large diameter portion of the booster cylinder 21 and a small diameter portion contained in the injection cylinder 22 to cooperate with an injection piston 24 contained therein. Instead of coaxially arranging the booster cylinder 21 and the injection cylinder 22 as shown in FIg. 2, these two cylinders may be disposed at right angles. It is also possible to connect the small diameter portion of the booster cylinder to the injection cylinder by means of a pipe. In any case the injection piston and the booster piston are operatively interconnected by the pressurized operating fluid.

Accumulators 25 and 26 are provided for advancing to the left as viewed in the drawing the booster piston 23 and the injection piston 24, respectively. Pressurized operating fluid from a pump, not shown, is supplied to the accumulators 25 and 26 respectively through a pipe 60, pressure reducing valves 27 and 28, check valves 29 and 30 and pipe 58 and 59 for establishing a predetermined pressure in the accumulators. A low-high speed pilot check valve 31 including a mechanism for switching the forward speed of the injection piston 24 between low and high speeds and a pull check valve 37 to be described later in detail are connected between accumulator 26 and the rear chamber 33 of the injection cylinder 22. A booster pilot check valve 32 for advancing the booster piston 23 is interposed between the accumulator 25 and the rear chamber 35 of the booster cylinder 21. Check valves 38, 39, 40 and 50 are connected in pipes to operate as will be described hereinafter.

A limit switch 41 is adjustably mounted at any desired position along the path of the injection piston 24. When operated by the advancing piston 24, the limit switch 41 operates through a valve, not shown, to open a pilot check valve 44 which is used for permitting high speed forward movement of the injection piston 24 and to switch the low-high speed pilot check valve 31 to the high speed side. The speed of the injection piston 24 during its low speed forward movement is controlled by a throttle valve 48 connected to the drain pipe 59 of th injection cylinder 22. A limit switch 42 similar to limit switch 41 is provided to be operated by the injection piston 24 for operating a solenoid valve 47 to admit the operating fluid in the accumulator 25 into the rear chamber 35 of the booster cylinder 21 via pipes 64, 65 and 66 to advance the booster piston 23 at an extremely low speed, which is controlled by a throttle valve 51 connected in parallel with a check valve 52. A limit switch 43 similar to limit switch 41 is also mounted in the path of movement of the injection piston 24 to be operated thereby at an instant when the injection piston reaches a position just prior to the limit of pouring of molten metal for energizing a solenoid valve 46 thus opening a sequence valve 45. When this valve is opened, the operating fluid in the booster pilot check valve 32 is discharged via pipe 71, a needle valve 50, sequenc valve 45 and pipe 72. Then, the booster pilot check valve 32 is opened for advancing the booster piston 23 at a speed higher than said extremely low speed, thus supplying a large quantity of the operating fluid into the rear chamber 35 of the booster cylinder 21 from accumulator 25. The purpose of the needle valve 50 is to control the high speed movement of the booster piston 23 by controlling the rate of discharge of the operating fluid from the booster pilot check valve 32 as well as the quantity of the operating fluid flowing into the rear chamber 35 of the booster cylinder 21. A solenoid valve 53 is provided which is energized when the metal mould is opened for the purpose of ejecting the moulded product out of the mould after the pressure increasing operation has completed and the moulded product has cooled and solidified. When the solenoid valve 53 is operated, the operating fluid from accumulator 26 flows into the rear chamber 79 of the pull check valve 37 via pipe 80, solenoide valve 53, check valve 38 and pipes 81 and 77 for moving the piston 62 of the pull check valve 37 to the left. As a consequence, the operating fluid from accumulator 26 flows into the rear chamber 33 of the injection cylinder 22 through radial openings 56 and 57 of the pull check valve 37, thereby advancing the injection piston 24 to a limit of its forward movement for ejecting the moulded product out of the metal mould. A sequence valve 76 is provided for the purpose of ensuring supply of the operating fluid to the rear chamber 33 of the injection cylinder 22 even when the load on the injection piston increases as a result of pouring molten metal into the mould. To this end, the sequence valve 76 is connected such that when the solenoid valve 53 is opened, the sequence valve 76 is opened by the operating fluid supplied thereto from pipe 80 through solenoid valve 53 and a pipe 84 for admitting the operating fluid in the fore chamber 34 of the injection cylinder 22 and into the rear chamber 79 of the cylinder 78 of the pull check valve 37 whereby the piston 62 is moved to the left for opening the pull check valve 37.

The injection apparatus shown in FIG. 2 operates as follows. When solenoid valve 49 is set to the neutral position shown for the purpose of advancing the injection piston 24, the operating fluid in the accumulator 26 flows into the rear chamber 33 of the injection cylinder 22 via pipe 54, the low-high speed pilot check valve 31 which has been switched to a low speed condition beforehand, pipe 55, openings 56 and 57 of the pull check valve 37 and pipe 58.

On the other hand, the operating fluid in the fore chamber 34 of the injection cylinder 22 is discharged into reservoir T through pipes 59 and 60, throttle valve 48, pipe 61 and solenoid valve 49. Consequently, the injection piston 24 begins to advance toward left at a low speed, which is controlled by the adjustment of the throttle valve 48. When the limit switch 41 is operated by the continued advancement of the injection piston 24 the pilot check valve 44 is opened through a valve, not shown, for discharging the operating fluid in the force chamber 34 of the injection cylinder 22 via pipe 59 and pilot check valve 44. At the same time, the low-high speed pilot check valve 31 is switched to high speed by the action of limit switch 41 for introducing a large quantity of the operating fluid into the rear chamber 33 of the injection cylinder 22. Now the injection piston 24 is advanced at a high speed. The position at which the injection piston 24 commences its high speed forward movement can be adjusted to any desired position by varying the position of the limit switch 41. As the limit switch 42 is operated by the injection piston 24 now moving at the high speed, solenoid valve 47 is energized for introducing the operating fluid in the accumulator 25 into the rear chamber 35 of the booster cylinder 21 via pipes 63 and 64, solenoid valve 47, pipe 65, throttle valve 51 and pipe 66. Consequently, the booster piston 23 begins to move forwardly at an extremely slow speed determined by the throttle valve 51..

When the injection piston 24 reaches a position immediately prior to the limit of pouring of molten metal at which pouring of the molten metal in the metal mould completes, limit switch 43 is operated by the injection piston 24 thus energizing solenoid valve 46. When this valve is opened the operating fluid in the accumulator 26 is supplied to sequence valve 45 through pipes 68 and 69, solenoide valve 46 and pipe 47. As a sequence, valve 45 is opened, to discharge the operating fluid in the booster pilot check valve 32 through pipe 71, needle valve 50, sequence valve 45 and pipe 72 thereby fully opening the pilot check valve 32. Thus, a large quantity of the operating fluid in the accumulator 25 flows into the rear chamber 35 of the booster cylinder 21 through pipes 63, 73 and 66 to change the speed of the booster piston 23 from the extremely low speed to high speed. Since the fore chamber 36 of the booster cylinder 21 is normally vent to atmosphere through pipe 67 and since the operating fluid contained in the fore chamber 36 does not resist to the forward movement of the booster piston 23, it can move in the forward direction at a higher speed than in the prior art injection apparatus.

Figure 1:
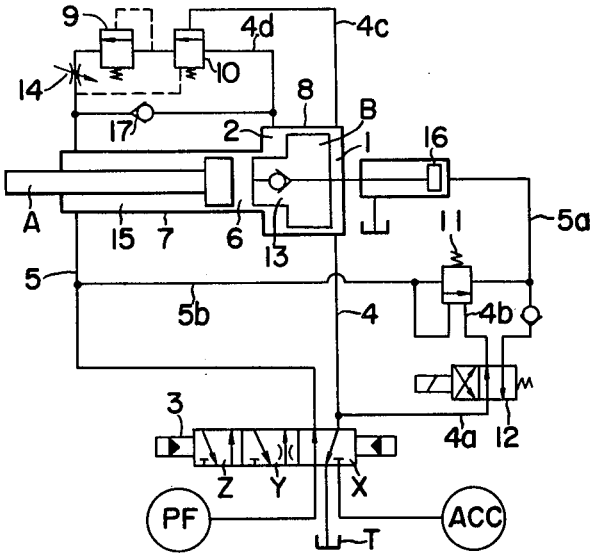
FIG. 1 PRIOR ART
FIG. 1 is a diagrammatic representation of a typical prior art injection apparatus of a die cast machine.
Figure 4:
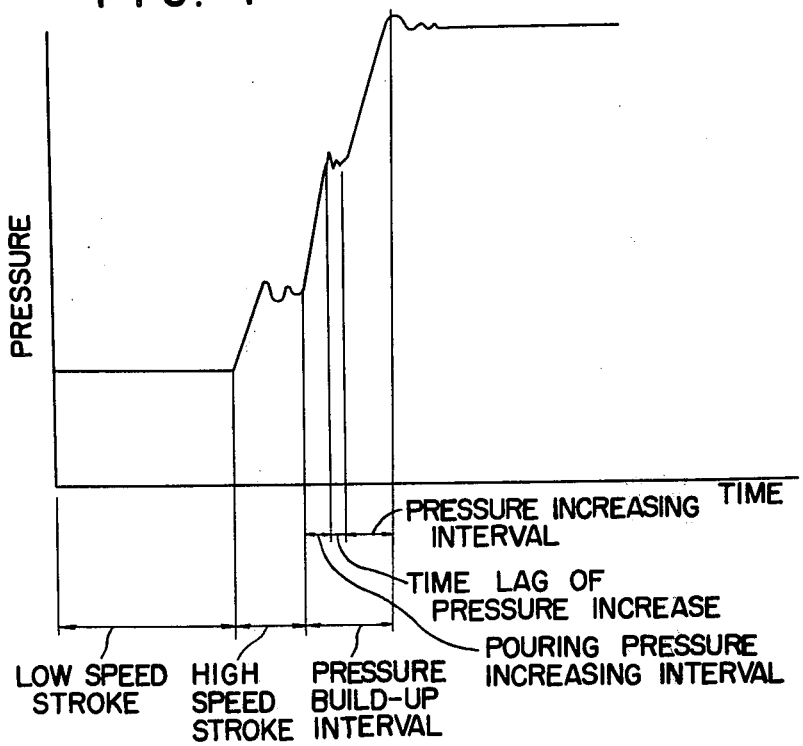
FIG. 4 is an oscillogram showing the relationship between the pressure and time prevailing during the operation of the injection piston of a die cast machine.

The speed of this high speed movement determines the length of the pressure increasing interval shown in FIG. 4. According to this invention is is possible to adjust the speed of the high speed forward movement of the booster piston 23 and hence the pressure increasing interval by adjusting the rate of discharge of the operating fluid in the booster pilot check valve 32 by means of needle valve 50.

As the injection piston 24 reaches the limit of pouring it can not continue its high speed forward movement so that the pressure of the operating fluid in the rear chamber 33 of the injection cylinder 22 begins to rise. The operating fluid of increased pressure enters into the pull check valve 37 through its radial opening 57 for moving piston 62 toward right. This righthand movement of piston 62 interrupts the communication between openings 56 and 57 whereby the operating fluid in the rear chamber 33 of the injection cylinder 22 is sealed. Consequently, the pressure of the operating fluid in the rear chamber 33 is increased by the booster piston 23 which is now advancing at the high speed, thereby increasing the pressure applied upon the injection piston 24. Upon completion of the pressure increasing operation the moulded product in the metal mould cools and solidifies. Then, concurrently with the opening of the metal mould solenoid valve 53 is energized to introduce the operating fluid in accumulator 26 into the rear chamber 79 of the cylinder 78 of the pull check valve 37 via low-high speed pilot check valve 31 which has been switched to low speed concurrently with the completion of said pressure increasing operation, pipes 55 and 80, solenoid valve 53, check valve 38 and pipes 81 and 77, thus moving piston 62 toward left. Consequently, the operating fluid in the accumulator 26 flows into the rear chamber 33 of the injection cylinder 22 through openings 56 and 57 of the pull check valve 37, and pipe 58 to further advance the injection piston 24 until it reaches a limit of forward movement. Thus the molded product is ejected from the metal mould.

When the booster piston 23 and the injection piston 24 are moved in the rearward direction to the position shown in the drawing, an electric signal which is generated when the pressure increasing operation has completed functions to close the low-high speed pilot check valve 71 and the booster pilot check valve 32 and to switch the solenoid valve 49 to the lefthand position L from its neurtal position thus admitting the operating fluid from pump PF into the fore chamber 34 of the injection cylinder 22 via solenoid valve 49, pipe 61, check valve 39 and pipe 59. Since piston 62 of the pull check valve 37 has already been moved to the left, the operating fluid in the rear chamber 33 of the injection cylinder 22 will be discharged into reservoir T through openings 57 and 56 of the pull check valve 37, pipe 68 and the solenoid valve 49. As a result, the injection cylinder 24 can retract to the position shown in FIG. 2. Concurrently with the retraction of the injection piston 24, the operating fluid in the rear chamber 35 of the booster cylinder 21 will be discharged into the reservoir via pipe 66, check valve 52, pipe 65 and solenoid valve 47. Accordingly, the booster piston 23 will be returned to the position shown by the rearward movement of the injection piston 24.

Figure 3:
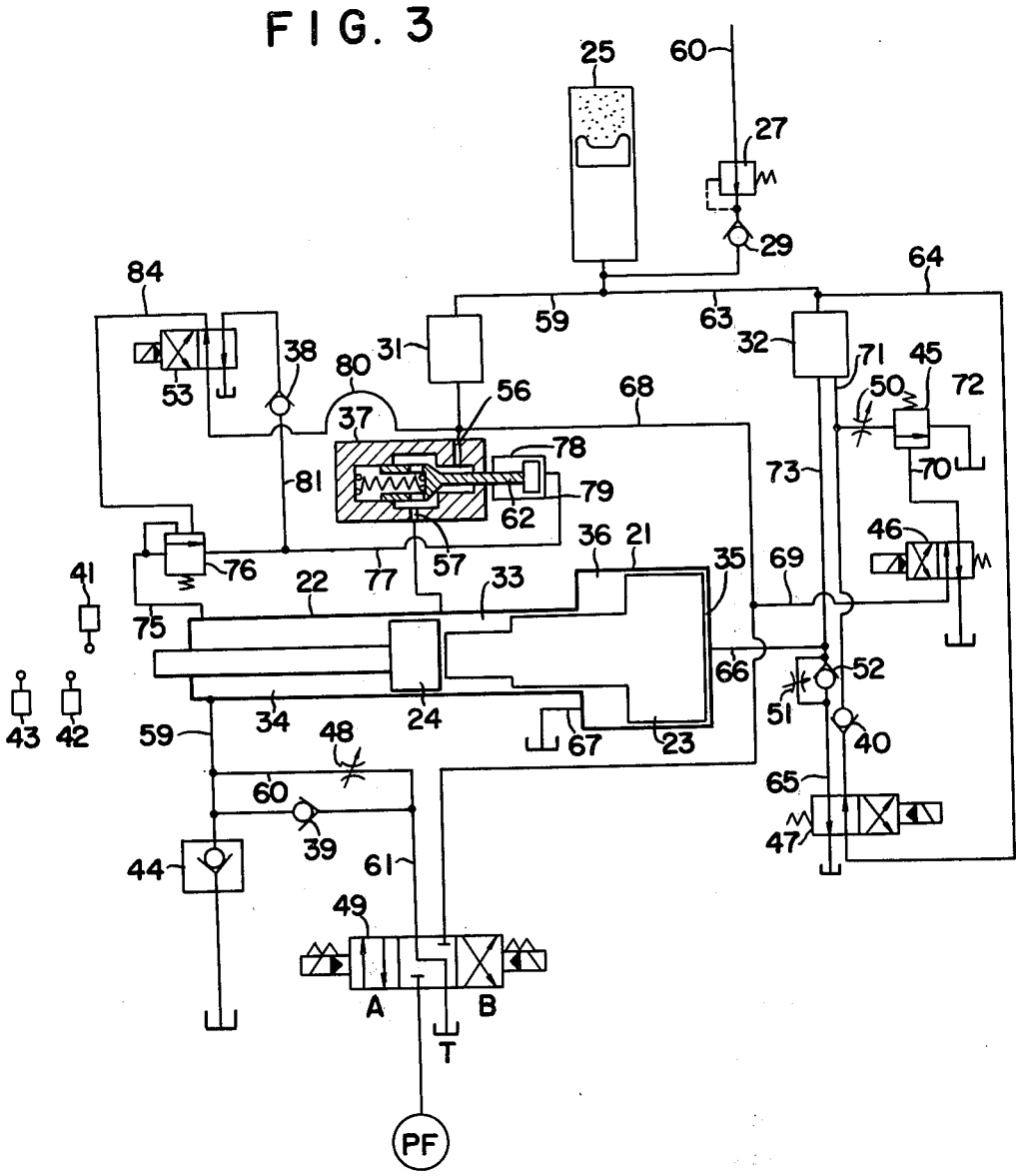
FIG. 3 shows a modified fluid pressure control system.

Although in this embodiment the signals for advancing the booster piston 23 are generated by limit switches 42 and 43 it should be understood that such signals can also be generated by a timer or the like associated with the injection piston such that it commences it timing operation whenever the injection piston begins to move in the forward direction. FIG. 3 shows a modification of this invention wherein the same accumulator is used as the source of pressure for advancing the booster piston 23 and the injection piston 24 and wherein component elements corresponding to those shown in FIG. 2 are designated by the same reference numerals. This embodiment operates in the same manner as that shown in FIG. 2.

As has been described hereinabove according to this invention there is provided improved injection aparatus for die casting machines wherein the booster piston is started at any desired point in the forward stroke of the injection piston so as to decrease the switching time of various valves. Furthermore, the time required for increasing the pressure acting upon the injection piston is greatly decreased by venting the fore chamber of the booster cylinder to the atmosphere and by adjusting the quantity of the operating fluid escaping from the booster pilot check valve by means of a needle valve at the time of increasing the injection pressure. This feature is advantageous for casting products which require to increase the injection pressure at earlier stages.

I claim:

1. In an injection apparatus for a die casting machine comprising an injection cylinder containing an injection piston for injection molten metal into metal mold of the die cast machine; a booster cylinder including a small diameter portion connected to said injection cylinder and a large diameter portion; a booster piston contained in the booster cylinder having a small diameter piston portion operatively connected to said injection piston through operating fluid in a large diameter piston portion contained in the large diameter portion of said booster cylinder, said large diameter portion of said booster piston being slideably contained in the large diameter portion of said booster cylinder to define a rear chamber and a fore chamber; a source of pressurized operating fluid; a low-high speed pilot valve connected between said source of operating fluid and the rear chamber of said injection cylinder, said low-high speed pilot valve being set at a low speed condition at the start of the injection operation, a first throttle valve connected to a conduit for discharging the operating fluid in a fore chamber of the injection cylinder defined by the injection cylinder and injection piston thereby permitting the injection piston to advance at a low speed; a pilot check valve connected to said conduit operatively connected to said first throttle valve and the fore chamber of said injection cylinder, a first limit switch operatively connected to said pilot check valve and located in the path of the movement of said injection piston to be operated thereby for opening said pilot check valve to rapidly discharge the operating fluid in the fore chamber of the injection cylinder and for switching said low-high speed pilot check valve to a high speed condition for supplying a large quantity in the operating fluid to a rear chamber of the injection cylinder defined by the injection piston, the injection cylinder, the small diameter portion of the booster cylinder and the small diameter portion of the booster piston so as to advance the injection piston at a high speed, a booster pilot valve connected between said source of operating fluid and the rear chamber of the booster cylinder, a solenoid valve and a second throttle valve which are connected between the source of operating fluid and the rear chamber of the booster cylinder, a second limit switch operatively connected to said solenoid valve and positioned along the path of the injection piston to be operated thereby for opening said solenoid valve thus advancing the booster piston at a low speed, a third limit switch operatively connected to said booster pilot check valve and located along the path of the injection piston at a point near the limit of pouring of molten metal, said third limit switch when actuated by the injection piston fully opening said booster pilot check valve thus admitting a large quantity of operating fluid into the rear chamber of the booster cylinder for advancing the booster piston at a high speed.

2. The injection apparatus according to claim 1 wherein said third limit switch opens said booster pilot check valve by discharging the operating fluid in said booster pilot check valve through a needle valve.

3. The injection apparatus according to claim 1 which further comprises a pull check valve connected between said low-high speed pilot check valve and the rear chamber of the injection cylinder, said pull check valve being provided with openings respectively communicating with said low-high speed check valve and said rear chamber of said injection cylinder and a piston for controlling the fluid communication between said openings.

4. The injection apparatus according to claim 1 wherein said first, second and third limit switches are positioned at positions remote from said injection cylinder in the order mentioned.

5. The injection apparatus according to claim 1 wherein the positions of said first, second and third limit switches are adjustable along the path of said injection piston.

* * * * *